US005105595A

United States Patent [19]

Tokei et al.

[11] Patent Number: 5,105,595

[45] Date of Patent: Apr. 21, 1992

[54] MOLD PANEL UNIT AND SPRING-WATER PROCESSING STRUCTURE USING MOLD PANEL UNITS

[75] Inventors: Shintaro Tokei; Yoichi Seki; Kazufumi Sumiyama; Masao Obata; Akio Shinozaki; Saburo Kozeki, all of Tokyo, Japan

[73] Assignee: Shimizu Construction Co., Ltd., Tokyo, Japan

[21] Appl. No.: 500,295

[22] Filed: Mar. 27, 1990

[30] Foreign Application Priority Data

Mar. 31, 1989 [JP] Japan ..... 1-282344

[51] Int. Cl.[5] ..... E04B 5/08; E21F 16/00

[52] U.S. Cl. ..... 52/381; 52/169.5; 52/302

[58] Field of Search ..... 52/577, 381, 302, 335, 52/169.5, 508

[56] References Cited

U.S. PATENT DOCUMENTS 3,334,458 8/1967 Leemhuis ..... 52/381
3,352,079 11/1967 Strong ..... 52/381
4,637,184 1/1987 Radtke ..... 52/577
4,702,048 10/1987 Millman ..... 52/577
4,923,733 5/1990 Herbest ..... 52/381

FOREIGN PATENT DOCUMENTS 60-40436 3/1985 Japan .

*Primary Examiner*—John E. Murtagh
*Attorney, Agent, or Firm*—Darby & Darby

[57] ABSTRACT

In a mold panel unit for constructing, for example, a spring-water processing layer, a mold panel is made of a synthetic resinous material or a fiber-reinforced material. A plurality of projections identical in configuration with each other are formed on the one side of the mold panel. A plurality of recesses are formed in the other side of said mold panel in corresponding relation to the respective projections. In addition, a spring-water processing structure formed on a grade slab includes a plurality of mold panel units which are laid on the grade slab such that end faces of the respective projections of each of the mold panel units are in abutment with an upper surface of the grade slab, and the recesses of the mold panel unit open upwardly. A cement filler is aftercast on said mold panel units.

7 Claims, 4 Drawing Sheets

MOLD PANEL UNIT AND SPRING-WATER PROCESSING STRUCTURE USING MOLD PANEL UNITS

BACKGROUND OF THE INVENTION

The present invention relates to a mold panel unit and a spring-water processing structure using a plurality of mold panel units.

In recent years, in construction of buildings, a method of construction has increased in which underground beams are dispensed with to reduce the depth of underground excavation, and a batholith is brought to a flat slab. In the case where the underground batholith is brought to the flat slab, however, a space for storing spring water is not formed, differentiated from construction of the underground beams. Thus, such a problem arises as to how the spring water is processed.

FIGS. 8 through 10 show a spring-water processing structure which has been provided at present in carrying-out of the method of construction in which the batholith is brought to the flat slab.

A spring-water processing layer 3 is formed on an upper surface of a flat slab 2 which is formed on an underground ground 1. An after-cast slab 4 is formed on an upper surface of the spring-water processing layer 3.

The spring-water processing layer 3 utilizes a plurality of blocks 5, as shown, for example, in FIG. 10, which are laid on the upper surface of the flat slab 2. Each of the blacks 5 has a planar plate section 5*a* and a pair of legs 5*b* and 5*b* projecting from one side of the plate section 5*a*. Thus, a plurality of spaces 6 are defined between the planar surface sections 5*a* of the respective blocks 5 and the upper surface of the lower slab or flat slab 2. The spaces 6 communicate with each other longitudinally and laterally.

Each of the blocks 5 is normally or usually formed into such a configuration as to have its length and width of a few tens of centimeters. The block 5 is made of, for example, a concrete block, a brick or the like, in order to enable a load resting on the block 5 to be withstood. A sheet 7 is laid on the upper surface of the spring-water processing layer 3 for water shielding.

The spring-water processing layer 3 is formed as follows. That is, the flat slab 2 is formed and, subsequently, the plurality of blocks 5 are laid on the upper surface of the flat slab 2 such that the planer plate sections 5*a* are directed upwardly. After the sheet 7 has been laid on the laid blocks 5, concrete is cast on the sheet 7 to form the after-cast slab 4.

The above-described method of construction can introduce the spring water to a predetermined location through the spaces 6 to process the spring water. However, the method of construction has the following disadvantages.

That is, the blocks 5 forming the spring-water processing layer 3 must support the load of the after-cast slab 4 per se and the loads resting on the after-cast slab 4. Accordingly, a component strength is required for each of the blocks 5. Thus, as will be seen from the fact that each block 5 is made from a concrete block, a brick or the like, it is natural that the block 5 has a certain weight. Moreover, in order, for example, to secure larger spaces 6 for processing the spring water, it is required that the legs 5*b* have their lengthened projecting lengths, or spacing between the legs 5*b* increases or is widened. In either case, the cross-sectional area of each leg 5*b* or each planer plate section 5*a* must increase or must be enlarged, so that the block 5 further increases in weight.

Furthermore, the following problems arise in the above-mentioned construction. That is, since the plurality of blocks 5, which are relatively heavy, must be laid, an excessive burden or load is applied to an operator. Further, the blocks 5 per se increase in manufacturing cost and in conveyance or transport cost.

SUMMARY OF THE INVENTION

It is therefore an object of the invention to provide a mold panel unit which is low in manufacturing cost, and which is facilitated in construction for use particularly in formation of a spring-water processing layer.

It is another object of the invention to provide a spring-water processing structure which utilizes a plurality of mold panel units.

According to the invention, there is provided a mold panel unit comprising:

a mold panel having one and other sides and made of one of a synthetic resinous material and a fiber-reinforced plastic material;

a plurality of projections identical in configuration with each other, the projections being formed on the one side of the mold panel; and a plurality of recesses formed in the other side of the mold panel in corresponding relation to the respective projections.

With the arrangement of the invention, since the mold panel is made of the synthetic resinous material or the fiber-reinforced plastic material, it is possible to manufacture the mold panel unit easily and at a low cost. Further, the mold panel unit is light in weight, a burden on an operator can be reduced, and is advantageous in conveyance or transportation. In addition, since the mold panel unit is light in weight, it is possible to enlarge the size of the single mold panel unit so that a construction efficiency can be improved. Furthermore, since the projections on the mold panel unit are engaged respectively with the recesses in another mold panel unit so that these mold panel units can be superimposed upon each other, carrying of the mold panel units and storage thereof are made possible under such a condition that the mold panel units are superimposed upon each other. Thus, the operation can further be improved in efficiency.

Preferably, the mold panel is rectangular in plan having first two sides adjacent each other and second two sides adjacent each other in opposed relation to the first sides. The first sides are provided with first connecting means, while the second sides are provided with second connecting means which is capable of being engaged with the first connecting means.

With the above arrangement of the invention, when a plurality of mold panel units are laid, the adjacent mold panel units can be arranged without gap reliably and quickly by means of the first and second connecting means. Thus, it is possible to unite the mold panel units to each other so that the operation can be improved in efficiency.

Preferably, the projections are arranged longitudinally and laterally of the mold panel in equidistantly spaced relation to each other. The mold panel unit further includes a plurality of projecting ridges formed in a checkerwise manner respectively between rows and columns of the projections arranged longitudinally and laterally of the mold panel. The projecting ridges projecting on the same side as the projections.

Preferably, the mold panel unit further includes a plurality of cross projecting ridges. Four of the cross projecting ridges are formed respectively in four sides of each of a plurality of checkers formed by the first-mentioned projecting ridges. The four cross projecting ridges being intersected respectively with the four sides of the checker and projecting on the same side as a corresponding one of the projections, which is located adjacent the four sides of the checker.

With the above arrangement of the invention, by the projecting ridges and the cross projecting ridges, the mold panel unit can have its high strength and rigidity in spite of the fact that the mold panel unit is thin in wall thickness.

According to the invention, there is further provided a spring-water processing structure formed on a grade slab, comprising:

a plurality of mold panel units each of which includes a mold panel having one and other sides and made of one of a synthetic resinous material and a fiber-reinforced plastic material, a plurality of projections identical in configuration with each other, the projections being formed on the one side of the mold panel, and a plurality of recesses formed in the other side of the mold panel in corresponding relation to the respective projections;

wherein the mold panel units are laid on the grade slab such that end faces of the respective projections of each of the mold panel units are in abutment with an upper surface of the grade slab, and the recesses of the mold panel unit open upwardly; and a cement filler after-cast on the mold panel units.

With the arrangement of the invention, since the recesses in the mold panel units are filled with the cement filler such as concrete or the like which is after-cast on the mold panel units, a plurality of spaces serving to process the spring water are formed by the cement filler which is integrated with the mold panel units.

After the after-cast cement filler has been cured or hardened, the mold panel units do not structurally support resting loads. Accordingly, it is possible to use the mold panel units which are thin in wall thickness and low in rigidity. Thus, the mold panel units can be made of the synthetic resinous material or the fiber-reinforce plastic material. In this manner, the mold panel units can be formed in mass production at low cost by the use of a usual plastic molding method. Moreover, since the mold panel units are light in weight, it is possible to operate the mold panel units on the spot extremely easily and efficiently.

Specifically, the spring-water processing structure can obtain the following various functional advantages. That is, since the recesses in the mold panel units are filled with the after-cast cement filler thereby forming a spring-water processing layer or a plurality of spaces, a plurality of legs are formed by the projections in which the recesses are filled with the cement filler after-cast on the mold panel units. Thus, even in the case where the spring-water processing spaces are taken large, it is possible to leave a margin in strength to the spring-water processing structure without any affection or influence in cost. Accordingly, it is possible to construct, at low cost, the spring-water processing layer which is high in processing ability. Moreover, since the after-cast cement filler is not into direct contact with the spring water, there is no such a hindrance that the spring-water processing layer is narrowed due to efflorescence or the like of the cement filler, so that the spring-water processing layer can fulfill its original function for a long period of time.

DESCRIPTION OF THE EMBODIMENTS

Figure 1:
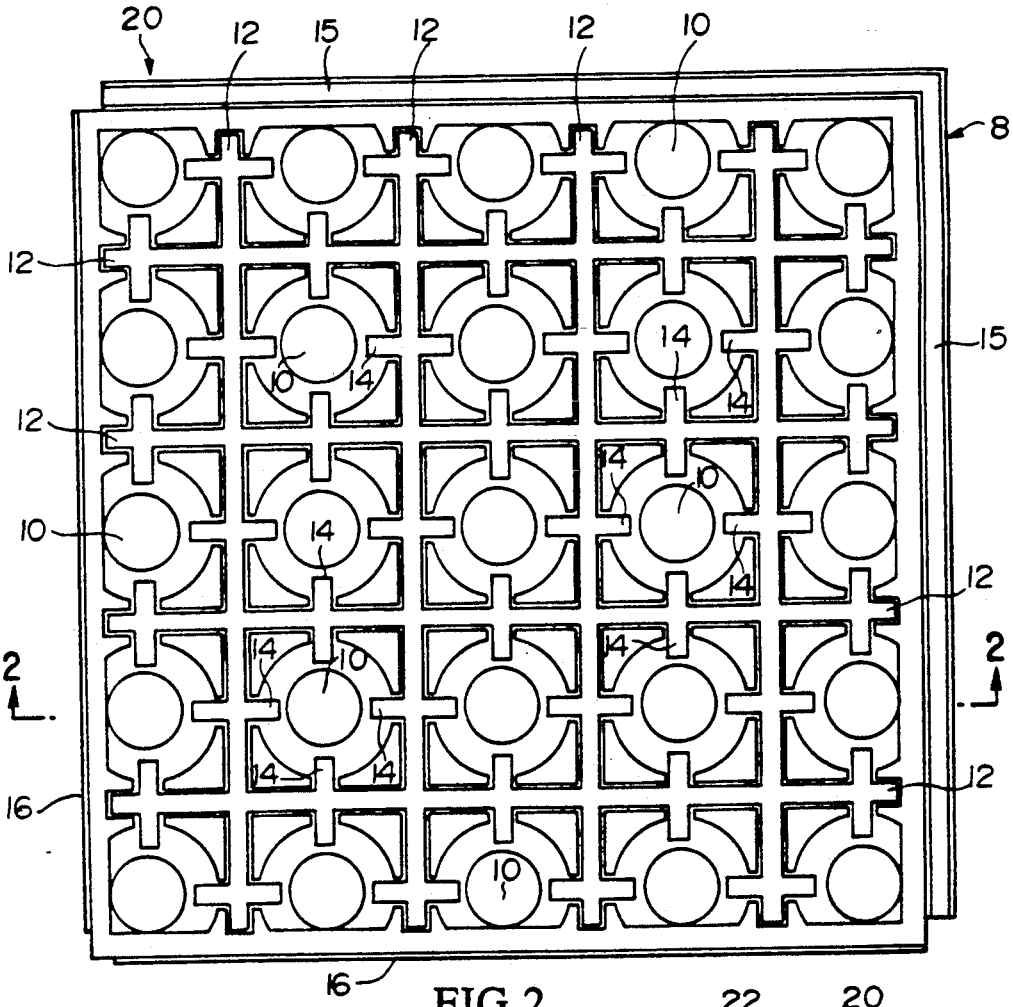
FIG. 1 is a top plan view of the entirety of a mold panel unit according to an embodiment of the invention.
Figure 2:
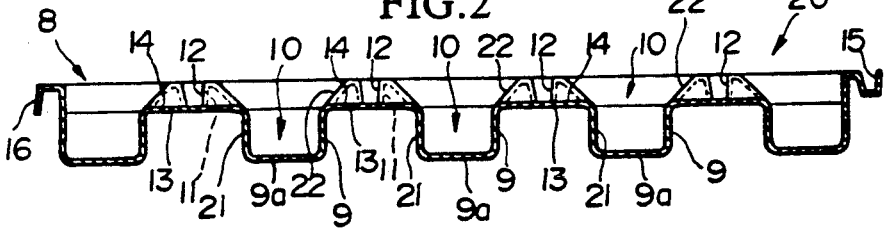
FIG. 2 is a cross-sectional view taken along the line II—II in FIG. 1.

Referring first to FIGS. 1 and 2, there is shown a mold panel unit, generally designated by the reference numeral 20, according to an embodiment of the invention. The mold panel unit 20 comprises a mold panel 8 which is made of a synthetic resinous material or a fiber-reinforced material. A plurality of projections 9 discontinuous from each other are formed on one side of the mold panel 8, and are identical in configuration with each other. A plurality of recesses 10 are formed in the other side of the mold panel 8 in corresponding relation to the respective projections 9.

Each of the projections 9 has an end face 9*a* which is planar, an intermediate section 21 which is cylindrical in configuration; and a proximal end section 22 which is formed into a frustum of cone diverging away from the end face 9*a*. The projections 9 are arranged longitudinally and laterally of the mold panel 8 in equidistantly spaced relation to each other. A plurality of projecting ridges 11 are formed longitudinally and laterally in a checkerwise manner respectively between rows and columns of the projections 9 which are arranged longitudinally and laterally of the mold panel 8. The projecting ridges 11 project on the same side as the projections 9*a*. That is, each of the projections 9 is located within a corresponding one of a plurality of checkers formed by the projecting ridges 11. Similarly to the projections 9, when the mold panel 8 is viewed from the other side thereof, a plurality of grooves 12 are formed in corresponding relation to the respective projecting ridges 11.

Further, a plurality of cross projecting ridges 13 or cross grooves 14 are provided in which four of the cross projecting ridges 13 or the cross grooves 14 are formed respectively in four sides of each of a plurality of checkers formed by the projecting ridges 11 or the grooves 12. The four cross projecting ridges 13 or the cross grooves 14 are intersected at right angles respectively with the four sides of the checker and project on the same side as a corresponding one of the projections 9 or the recesses 10, which is located adjacent the four sides of the checker.

The mold panel unit 20 is rectangular in plan having a predetermined configuration in which first two sides are located adjacent each other and second two sides are located adjacent each other in opposed relation to the first sides. The first sides are provided respectively with a pair of engaging grooves 15 each in the form of a trough, while the second sides are provided with a pair of engaging hooks 16 which are capable of being engaged respectively with the pair of engaging grooves 15 of an identical mold panel unit. The pair of engaging grooves 15 serve as first connecting means, while the pair of engaging hooks 16 serve as second connecting means which is capable of being engaged with the first connecting means. The first and second connecting means serve to connect a plurality of mold panel units 20 and 20 to each other subsequently to be described.

Figure 4:
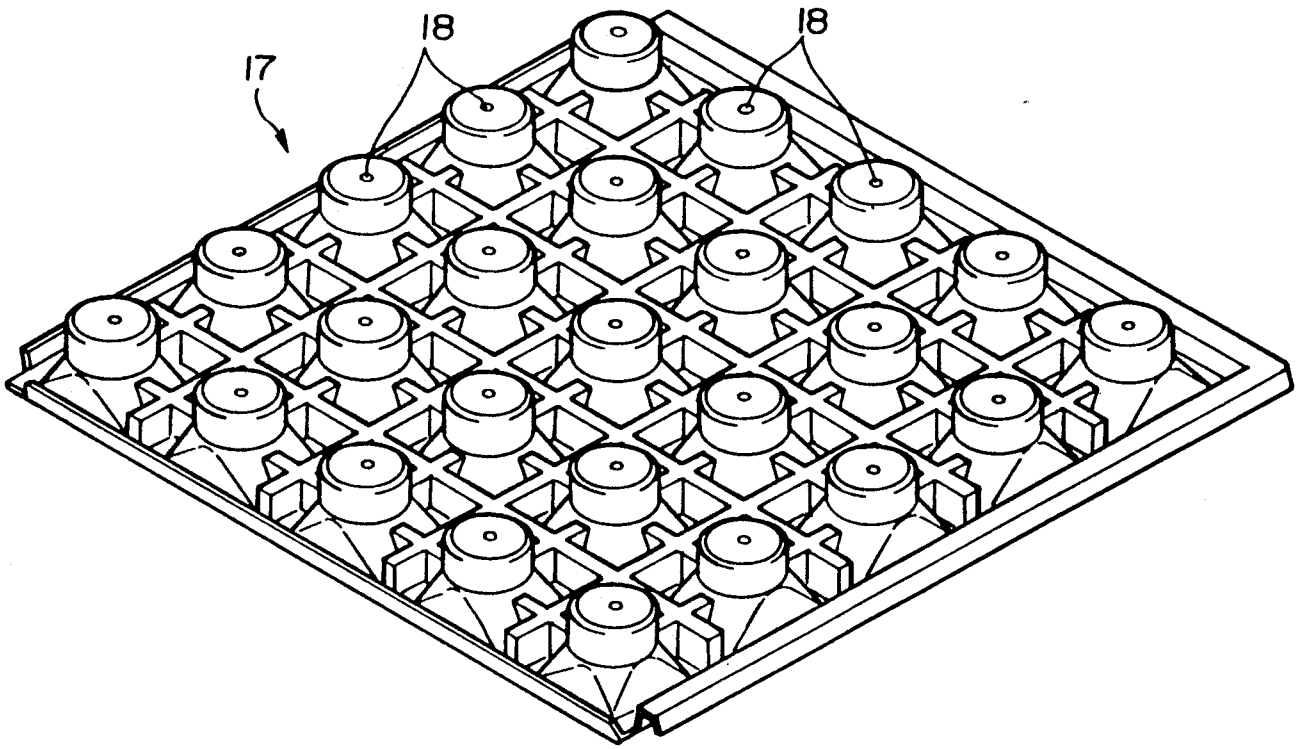
FIG. 4 is a perspective view of a mold for the mold panel unit illustrated in FIG. 1.

The mold panel 8 is made of a synthetic resinous material or a fiber-reinforced plastic (FRP) material. Accordingly, the mold panel 8 can easily be formed by one of usual or normal molding methods which are applied to articles made of such material. In the illustrated embodiment, the mold panel 8 is formed by a vacuum molding method which uses a mold 17 as shown in FIG. 4. As well known, an upper surface of an opening in the mold is closed by a material being processed in a closed contact manner or in an intimate contact manner. Air within the mold is drown through an air hole or an air bleeding hole formed in the bottom of the mold to draw the material being processed into the mold. Thus, deformation is given to the material being processed in accordance with the configuration of the mold. FIG. 4 shows the rear side of the mold 17, and a plurality of air holes used at vacuum molding are designated by the reference numerals 18.

A plurality of mold panel units 20, each of which is constructed as described above, can suitably be utilized for a spring-water processing structure.

Figure 7:
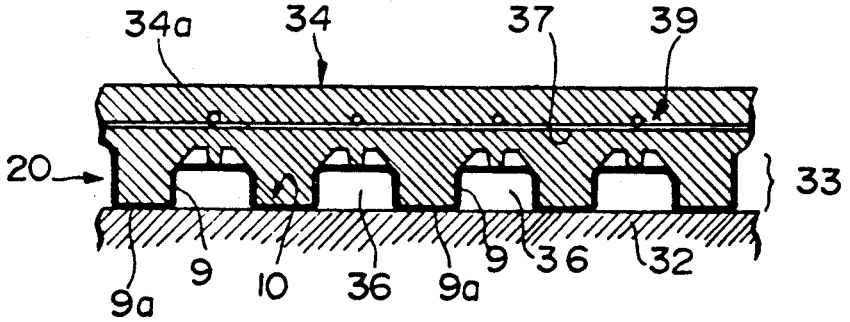
Figure 8:
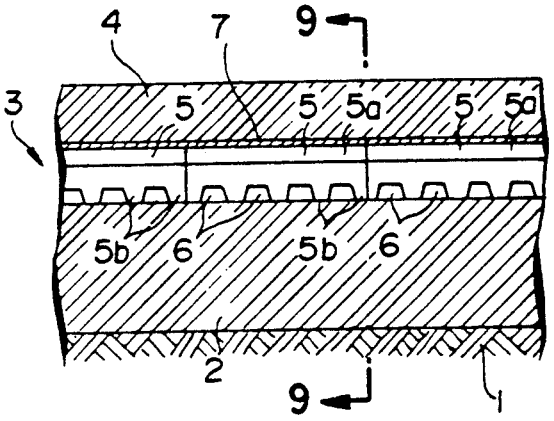
FIG.8 (PRIOR ART)
FIG. 8 is a cross-sectional side elevational view of the conventional spring-water processing layer.
Figure 9:
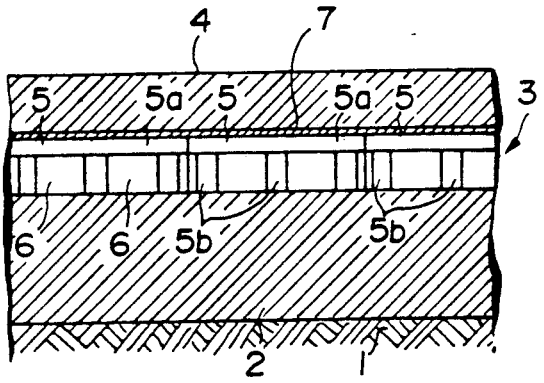
FIG.9 (PRIOR ART)
FIG. 9 is a cross-sectional view taken along the line IX—IX in FIG. 8.
Figure 10:
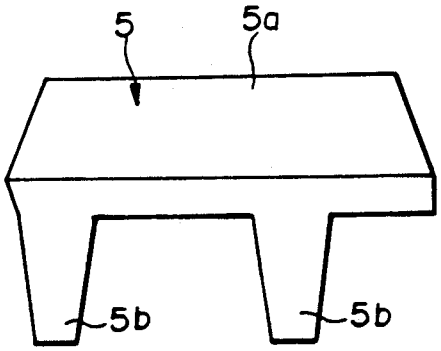
FIG.10 (PRIOR ART)
FIG. 10 is a perspective view of one of a plurality of blocks illustrated in FIGS. 8 and 9.

FIG. 7 shows a spring-water processing layer 3 which is constructed using the plurality of mold panel units 20.

In the spring-water processing layer 33, the mold panel units 20 are laid on a flat slab or grade slab 32 such that end faces 9*a* of the respective projections 9 of each of the mold panel units 20 are in abutment with an upper surface of the flat slab 32, and the recesses 10 of the mold panel unit 20 open upwardly. A cement filler or concrete 34*a* is after-cast on the mold panel units 20. In this connection, in the illustrated embodiment, a sheet 37 and a plurality of reinforcements 39 are embedded in an after-cast slab 34 formed by the concrete 34*a* in parallel relation to the mold panel units 20.

The spring-water processing layer 33 is constructed by the following procedure.

Figure 3:
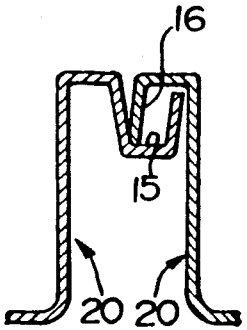
FIG. 3 is a fragmentary enlarged cross-sectional side elevational view of connecting means of the mold panel unit illustrated in FIG. 1.
Figure 5:
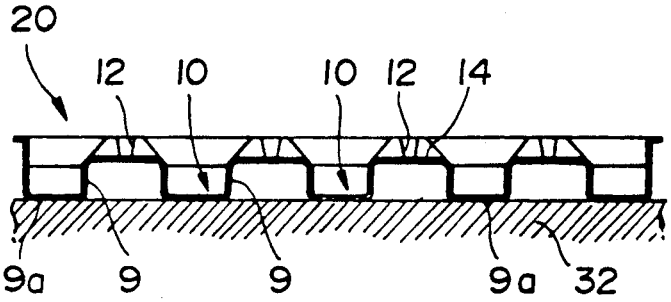
FIGS. 5 through 7 are fragmentary side elevational views showing, in order, steps of a method of construction of a spring-water processing structure according to an embodiment of the invention.
Figure 6:
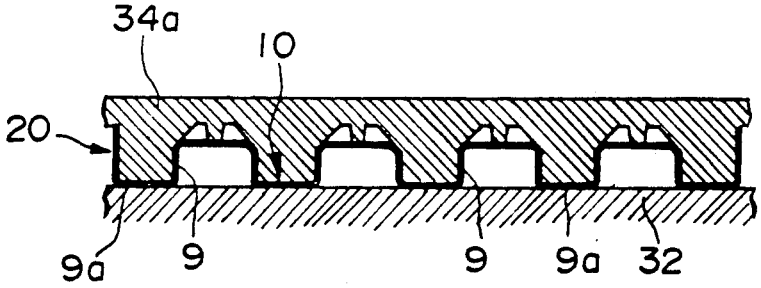

First, as shown in FIG. 5, the mold panel units 20 are laid on the flat slab 32 such that the end faces 9*a* of the respective projections 9 are in abutment with the upper surface of the flat slab 32. At this time, the recesses 10 open upwardly. As shown in FIG. 3, the adjacent mold panel units 20 and 20 are connected to each other in such a manner that the pair of engaging grooves 15 on one of the adjacent mold panel units 20 are engaged respectively with the pair of hooks 16 of the other mold panel unit 20. Thus, it is possible to lay or arrange the plurality of mold panel units 20 without gaps reliably, and such an attempt can be made that the plurality of mold panel units 20 are integrated or united.

Since the mold panel units 20 per se are extremely light in weight, handling of the mold panel units 20 is extremely easy. Further, because of the light weight, it is possible to increase the size or dimension of the single mold panel unit 20, for example, to the size in which one of the four sides of the mold panel unit 20 is brought to a few meters. Thus, it is possible to lay the mold panel units 20 on the flat slab 32 for a short period of time.

After the arrangement of the mold panel units 20 have been completed as shown in FIG. 5, the concrete 34*a* for construction of the after-case slab 34 is cast on the upper surfaces of the mold panel units 20 to such a degree that the mold panel units 20 are embedded completely in the cast concrete 34*a*. The reason why the concrete 34*a* corresponding in entire thickness to the after-case slab 34 is not cast at a breath is as follows. That is, the sheet 37 and the reinforcements 39 as shown in FIG. 7 are normally arranged within the after-cast slab 34, and the strength of the concrete 34*a*, which is filled in the recesses 10 to form respectively the projections 9, can be selected as occasion demands. In this connection, although the concrete 34*a* is cast on the mold panel units 20, other cement fillers such as mortar and the like may be filled in the mold panel units 20.

The cast concrete 34*a* is filled in the recesses 10 in the mold panel units 20 and, in addition thereto, in the grooves 12 and the cross grooves 14 in the case of the illustrated embodiment.

After a requisite strength has appeared in the concrete 34*a* cast on the mold panel units 20 in the manner described above, the sheet 37 is laid on the mold panel units 20 as shown in FIG. 7 and, further, the plurality of reinforcements 39 are arranged on the sheet 37. The concrete 34*a* is again cast on the reinforcements 39. Thus, construction of the spring-water processing layer 33 has been completed. The mold panel units 20 are embedded in the concrete 34*a*.

In the illustrated embodiment, the construction of the after-cast slab 34 has been carried into effect in two steps as described above. Since, however, the mold panel units 20 made of the synthetic resinous material or the fiber-reinforced plastic material have water-shielding ability or water-barrier ability per se, a plurality of spacers may be arranged on the mold panel units 20 without provision of the sheet 37, whereby, for example, the reinforcements 39 are arranged on the spacers and, subsequently the concrete 34*a* is cast to construct the after-cast slab 34.

In the spring-water processing layer 33, a plurality of spaces 36 are formed between the projections 9 of the mold panel units 20. By the spaces 36, it is possible to process the spring water.

In the manner described above, by the spring-water processing layer 33 formed by the plurality of mold panel units 20, construction of the spring-water processing structure can be realized at extremely low cost.

That is, the after-cast concrete 34*a* is filled in the projections 9 or the recesses 10 for forming the spaces 36 which fulfill function of spring-water processing, and the legs or the projections 9 are formed, after all, by the after-cast slab 34 per se. Accordingly, the use of the mold panel units 20 small in wall thickness and low in rigidity is made possible.

In the manner described above, since the mold panel units 20 are small in wall thickness and light in weight, it is extremely easy to carry the mold panel units 20. Moreover, since the mold panel units 20 are light in weight, it is possible to increase the size of the single mold panel unit 20. Thus, the operating efficiency at the spot can greatly be improved, and the construction cost can be reduced.

Further, since the legs or projections 9 for forming the spaces 36 are formed by the after-cast slab 34 or the after-cast concrete 34a as described above, a sufficient cross-section of each of the mold panel units 20 can be taken with respect to loads without any restriction or limitation. Thus, there is obtained such an advantage that it is possible to widen the spaces 36 to increase the spring-water processing ability. Further, since the after-cast concrete 34a and the spring water are not into direct contact with each other, such a hindrance does not occur that efflorescence of the concrete, that is, separating of calcium hydroxide hydrolyzed by lime hydroxide within the cement, causes the spring-water processing layer 33 to be narrowed.

Moreover, each of the mold panel units 20 can be manufactured at extremely low cost by the above-mentioned vacuum molding method or other suitable molding methods. Further, in transportation of the mold panel units 20 and at carrying-in thereof, the mold panel units 20 are light in weight and can be carried under such a condition that the mold panel units 20 are superimposed upon each other. Accordingly, there are obtained such functional advantages that the mold panel units 20 are easy in transportation and save space. Thus, it is possible to render the operation further efficient, and the cost can further be reduced.

Furthermore, since the projections 11 or the grooves 12 and the cross projecting ridges 13 or the cross grooves 14 are formed in the illustrated mold panel units 20, it is possible to raise the strength and rigidity of the mold panel units 20 per se.

In connection with the above, the projections 9, the recesses 10 and the like on and in each of the mold panel units 20 should not be limited in configuration and arrangement to those illustrated in FIGS. 1 and 2. The projections 9, the recesses 10 and so on may be ones having other configuration and arrangement unless various constitutional elements defined in the following claim 1 are provided.

Moreover, in the illustrated embodiment, only such an example is revealed that the mold panel units 20 are applied to the spring-water processing layer 33 or the spring-water processing structure. However, the use of the mold panel units 20 should not be limited to construction of the spring-water processing layer 33. For example, it is possible that a concrete construction has its outer wall in which the mold panel units are laid on the outer wall and are removed to finish a pattern on the outer wall. Further, it is also possible to utilize the mold panel units according to the embodiment of the invention to wiring of electric cables.

We claim:

1. A mold panel unit comprising:

a mold panel having one and other sides and made of one of a synthetic resinous material and a fiber-reinforced plastic material;

a plurality of projections each of identical shape, said projections being formed on the one side of said mold panel, said projections being arranged longitudinally and laterally of said mold panel in equidistantly spaced relation to one another;

a plurality of recesses formed in the other side of said mold panel in corresponding relation to the respective projections;

a plurality of projecting ridges formed continuously in a criss-crossing manner, respectively, between rows and columns of said projections to define a plurality of checkers each having four sides, said projecting ridges projecting on the same side as said projections, each of said projections being located within a corresponding one of said checkers formed by said projecting ridges; and a plurality of cross projecting ridges, four of said projecting ridges extending respectively from four sides of each of the checkers, the four cross projecting ridges being intersected respectively with the four sides of the checkers, respectively, and projecting on the same one side as are said projections.

2. The mold panel unit according to claim 1, wherein said mold panel is rectangular in plan having first two sides adjacent each other and second two sides adjacent each other in opposed relation to said first sides, said first sides being provided with first connecting means, while said second sides are provided with second connecting means which is capable of being engaged with said first connecting means.

3. The mold panel unit according to claim 2, wherein said first connecting means is a pair of engaging grooves provided respectively in said first sides, and said second connecting means is a pair of engaging hooks provided respectively on said second sides.

4. The mold panel unit according to claim 1, wherein said projections are discontinuous from each other.

5. The mold panel unit according to claim 1, wherein each of said projections has an end face which is planar, an intermediate section which is cylindrical in configuration, and a proximal end section which is formed into a frustum of cone diverging away from the end face.

6. A spring-water processing structure formed on a slab, comprising a plurality of mold panel units and a cement filler after-cast on said mold panel units, each of the mold panel units comprising:

a mold panel having one and other sides and made of one of a synthetic resinous material and a fiber-reinforced plastic material;

a plurality of projections each of identical shape, said projections being formed on the one side of said mold panel, said projections being arranged longitudinally and laterally of said mold panel in equidistantly spaced relation to one another;

a plurality of recesses formed in the other side of said mold panel in corresponding relation to the respective projections;

a plurality of projecting ridges formed continuously in a criss-crossing manner, respectively, between rows and columns of said projections to define a plurality of checkers each having four sides, said projecting ridges projecting on the same side as said projections, each of said projections being located within a corresponding one of said checkers formed by said projecting ridges; and a plurality of cross-projecting ridges each extending from and intersected by a respective side of said checkers and projecting on the same one side as are said projections, said mold panel units being laid on the slab such that end faces of the respective projections of each of said mold panel units are in abutment with an upper surface of the slab, said recesses of the mold panel unit opening upwardly.

7. The spring-water processing structure according to claim 6, further including a sheet and a plurality of reinforcements embedded in said cement filler in parallel relation to said mold panel units.

* * * * *